US005499478A

United States Patent [19]

Rimmele

[11] Patent Number: 5,499,478

[45] Date of Patent: Mar. 19, 1996

[54] LIGHTWEIGHT VERTICALLY PERFORATED BRICK

[76] Inventor: Raimund Rimmele, Altsteusslinger Strasse 24, D-89583 Ehingen, Germany

[21] Appl. No.: 156,778

[22] Filed: Nov. 24, 1993

[30] Foreign Application Priority Data

Nov. 25, 1992 [DE] Germany ..... 42 39 616.6
Feb. 25, 1993 [DE] Germany ..... 43 05 747.0

[51] Int. Cl.[6] ..... E04C 1/00; E04B 1/74; E04B 1/14

[52] U.S. Cl. ..... 52/606; 52/604; 52/605; 52/127.5

[58] Field of Search ..... 52/606, 604, 596, 52/127.5, 605

[56] References Cited

U.S. PATENT DOCUMENTS

| | | | |
|---|---|---|---|
| 1,686,373 | 10/1928 | Foster | 52/606 |
| 4,510,725 | 4/1985 | Wilson . | |

FOREIGN PATENT DOCUMENTS

| | | | |
|---|---|---|---|
| 0677668 | 12/1929 | France | 52/606 |
| 802951 | 1/1951 | Germany . | |
| 1917920 | 12/1969 | Germany . | |
| 2552699 | 7/1976 | Germany . | |
| 2640064 | 3/1977 | Germany . | |
| 2833412 | 2/1980 | Germany . | |
| 8334588 U | 1/1984 | Germany . | |
| 8406314 U | 4/1984 | Germany . | |
| 3343287 | 12/1984 | Germany . | |
| 3402541 | 8/1985 | Germany . | |
| 4005719 | 8/1991 | Germany . | |
| 0295268 | 4/1932 | Italy | 52/606 |
| 0463511 | 5/1951 | Italy | 52/606 |
| 0605729 | 7/1960 | Italy | 52/606 |
| 0312925 | 3/1956 | Switzerland | 52/606 |
| 434127 | 8/1935 | United Kingdom . | |

OTHER PUBLICATIONS

"Die Ziegelindustrie" [Brick Industry]; No. 23/24, 1970, p. 509.

Rochwarger, E. L. et al.: "Die Konstruktion und die Technologie der Herstellung dünnwandiger Platten ohne Dämmstoff." In: Die Ziegelindustrie, 1961, H.9, pp 264.

*Primary Examiner*—Robert J. Canfield
*Attorney, Agent, or Firm*—Spencer & Frank

[57] ABSTRACT

The invention proposes a lightweight vertically perforated brick having a perforation pattern comprising perforations which form a plurality of perforation rows, extending in the longitudinal direction, and are separated from one another by webs. In order to achieve an improved coefficient of thermal conductivity and to reduce the flank transmission, the invention proposes the combination of the following features: thickness of the webs ≦5 mm, ratio of the largest and smallest inside widths of the perforation cross-section is between 1:1 and 1:2.5, spacing of the perforation rows ≦22 mm, proportion of perforations ≧50% and apparent density of the brick material ≧1.5 kg/dm$^3$. Hexagonal perforations, with corners directed towards the side walls, and a fibrous porosity agent are to be preferred. The abutment surfaces should be designed such that they are essentially in mirror symmetry with respect to one another, with the result that the protrusions bear against one another and the depressions respectively form a cavity together.

12 Claims, 6 Drawing Sheets

LIGHTWEIGHT VERTICALLY PERFORATED BRICK

BACKGROUND OF THE INVENTION

The invention relates to a lightweight vertically perforated brick having a perforation pattern which exhibits a plurality of perforation rows, extending in the longitudinal direction, and webs separating the perforations from one another. Bricks of this type are used, predominantly in housing construction, for carrying out brick masonry work. They are laid in a conventional manner or are laid as flat bricks with thin-bed mortar.

The known bricks of this type have slot perforations, the perforations having a rectangular, elliptical, or in any case elongate cross-section and forming continuous vertical channels which are open at the top and bottom. The longitudinal axis of the perforation cross-section extends in the longitudinal direction of .the bricks and the perforations of neighboring perforation rows are frequently offset in the longitudinal direction with respect to one another. Known bricks which are best in terms of heat insulation, have a coefficient of thermal conductivity of $\lambda$=0.16 [W/m.K] or worse.

Endeavors to make the slot-shaped perforations longer are limited by an increased brittleness of the brick, because such long-web bricks are resistant neither to compression nor to transverse tension. The resistance to compression and the resistance to transverse tension constitute hitherto insurmountable barriers on the road to providing bricks with an even better heat-insulating capacity. Finally, it should be stressed that the acoustic phenomenon of the so-called flank transmission occurs in the case of known bricks, optimized in terms of heat insulation, with slot perforations.

SUMMARY OF THE INVENTION

An object of the invention is to provide a lightweight brick which, along with sufficient static strength, has markedly better heat-insulation properties than known lightweight bricks, in particular has a coefficient of thermal conductivity $\lambda \leqq 0.15$ [W/m.K] and, at the same time, has a good airborne-sound absorption capacity (sound resistance) without a tendency to flank transmission.

The above and other objects are accomplished in accordance with one embodiment of the invention by the provision of a light weight, vertically perforated brick having a pattern of perforations that exhibits a plurality of perforation rows, extending in a longitudinal direction of the brick, and webs separating the perforations from one another, wherein:

a) the webs have a thickness from 1.5 mm to not more than 4 mm;

b) each perforation has a cross section exhibiting a ratio of largest to smallest inside width that lies in a range of 1:1 to 1:1.25;

c) the perforation rows have a spacing of not more than 22 mm;

d) the perforations comprise a 50% proportion of the brick; and e) the brick is made of material having a density of less than or equal to 1.7 kg/dm$^3$.

In a preferred implementation of this embodiment, the density of the brick material is less than or equal to 1.5 kg/dm$^3$.

According to another embodiment of the invention there is provided a light weight, vertically perforated brick having a pattern of perforations that exhibits a plurality of perforation rows, extending in a longitudinal direction of the brick, and webs separating the perforations from one another, wherein:

a) the webs have a thickness from 2.0 mm to not more than 5 mm;

b) each perforation has a cross section exhibiting a ratio of largest to smallest inside width that lies in a range of 1:1 to 1:1.2;

c) the perforation rows have a spacing of not more than 20 mm;

d) the perforations comprise at least a 55% proportion of the brick; and e) the brick is made of material having a density of less than or equal to 1.55 kg/dm$^3$.

According to yet a further embodiment of the invention there is provided a light weight, vertically perforated brick having a pattern of perforations that exhibits a plurality of perforation rows, extending in a longitudinal direction of the brick, and webs separating the perforations from one another, wherein:

a) the webs have a thickness from 3.4 mm to not more than 4 mm;

b) each perforation has a cross section exhibiting a ratio of largest to smallest inside width that lies in a range of 1:1 to 1:1.2;

c) the perforation rows have a spacing of not more than 18 mm;

d) the perforations comprise a 60% proportion of the brick; and e) the brick is made of material having a density of less than or equal to 1.5 kg/dm$^3$.

The basic idea is that, by means of a perforation arrangement with a large number of small perforations and short webs, a high degree of rigidity, and, in comparison with the proportion of perforations, a high resistance to compression can be achieved. An essential determining variable for the thermal properties is the web thickness. It is thus expedient to proceed so that the web thickness is established at as small a value as possible, and then patterns with increasing percentage proportions of perforations are to be examined for their suitability in terms of statics and acoustics.

Even with a layer web thickness of 4 mm, in the case of average porosity, and 5 mm, in the case of high porosity, very low coefficients of thermal conductivity can be achieved in the case of a proportion of perforations of 50% or more.

In fact, all possible perforation patterns whose perforations do not have a pronounced slot shape can be considered for the purposes of the invention. Perforation cross-sections in the form of regular hexagons are particularly suitable. This structure, which is already given in a honeycomb, can be used, in a dimensioning with thin webs, which is novel for bricks, for extreme applications. The resistance to compression of a brick with filigree honeycomb perforations is, with the same apparent density of the brick, at least 25% higher than in the case of known bricks with conventional perforation patterns.

The honeycomb perforations are also notable for the ideal shape of the opening. This is due, on the one hand, to the fact that the thickness of the webs is the same at all locations. Even in comparison with a similarly filigree square or rhomboid pattern, however, the clay composition runs to a considerably better degree through the opening. This is the case because the webs do not cross over one another, but, on the contrary, only three webs come together at one point. At a crossover point, the clay shoots forward because the friction is lower in this region. A good opening shape, however, involves careful forming of the thin-walled structure and, thus, making full use of the strength thereof.

The honeycomb pattern may be oriented in any direction with respect to the longitudinal direction of the brick. The pattern is, however, preferably laid such that the heat path is as long as possible in the transverse direction of the brick, and this is the case when webs run perpendicularly to the fair faces (i.e., outside, exposed faces) of the brick or two opposite corners of the hexagons are directed towards the fair faces. The heat path is extended then by approximately 16% in comparison with the arrangement with webs parallel to the fair faces.

The fundamental advantage with perforation crosssections which are as symmetrical as possible at the center, in particular the hexagonal cross-section, is a virtually equal degree of rigidity in all directions. As a result, a flank transmission, i.e. the transmission of sound further into the wall plane, is prevented. Nowadays, this is one of the most important criteria for bricks used for exterior walls.

There are also advantages regarding the production of the bricks. Even the dried green bricks have a high breaking strength and are thus also ideal for face-grinding the horizontal bearing surfaces because they can be braced very firmly on the fair faces.

In the case of bricks with filigree structures, in particular in the case of filigree honeycomb perforations, the apparent density of the brick material (as opposed to the brick as a whole) can be reduced by porosity (FIG. 10). On the one hand, even a low degree of porosity gives low coefficients of thermal conductivity and, on the other hand, filigree structures permit a relatively high degree of porosity without the resistance to compression being thereby reduced to any great extent. The degree of porosity should, however, not be so extreme that resistance to compression is thereby reduced too far. With regard to the main aim of increasing the heat-insulating capacity, it is better to aim for an apparent density of the bodies $\leqq 1.7$ kg/dm$^3$ or even considerably lower than this. In this arrangement, the use of a fibrous porosity agent, in particular the use of paper fibers, is particularly advantageous. This gives rise, during firing, to fibrous, crosswise and transverse pores which, rather than producing cavities as a result of granulated or spherical porosity agents, produce a homogenous structure and do not disrupt the distribution of forces. It is also possible, however, to use other fine porosity agents, e.g. a fine slurry which does not contain any harmful substances.

Furthermore, a good plasticity of the moist column of clay is important, and this can be achieved in that the clay for the bricks is enriched by means of a proportion of approximately 5 to 25% of rich clay. Rich clay is a high-grade clay with a high content of $Al_2O_3$. Consequently, in addition to the perforation pattern which is favorable in terms of statics, the strength of the brick is influenced favorably despite a high proportion of perforations.

In the case of known brick shapes, the vertical-joint region always poses a problem in terms of heat insulation owing to the large accumulations of material in this area. This applies, in particular, to heat-optimized slotted bricks since a thick brick outer layer has to support the inner region, which is weak in terms of statics, in a compensating manner. In contrast, the proposed filigree small-perforation structure is stable to such an extent, and not weakened in the direction of transverse tension, that the abutment side can be provided with a comparatively thin outer layer.

In order to considerably reduce cold bridges in the vertical-joint region, the aim should be to move away from the widely used groove-and-tongue system. Instead of this, the invention proposes that the abutment surfaces of the brick be designed such that they are essentially in mirror symmetry with respect to one another, protrusions and depressions being formed in accordance with the perforation pattern and the progression of the walls which terminate the perforations, following one after the other in the transverse direction, to the outside, with the result that the mutually corresponding protrusions of two abutting bricks come to bear against one another and the mutually corresponding depressions respectively form a cavity together. Consequently, accumulations of material are reduced to an extent which has not been known hitherto and heat bridges are avoided. The difference between the structure of an abutment region formed in this manner and the rest of the perforation pattern is only minimal because the cavities of the depressions, which combine in pairs, form perforations similar to the rest of the perforations.

In order to close the thin gap which may possibly remain when the bricks butt against one another and to allow the bricks to interlock, at least to a small extent, in a positively locking manner as an aid for laying them, at least one tongue and one groove should be arranged in a coordinating manner on each vertical joint. For this purpose, the provision, on one of the two abutment surfaces of a brick, of one tongue, which projects beyond the protrusions and fits into one of the depressions of the abutting neighboring brick, is sufficient. Of course, a plurality of tongues may also be provided on said abutment surface. One tongue per brick is, however, to be preferred because the brick can then, if required, be set down on the other abutment surface after extrusion. In order to be able to insert the tongue easily into the associated depression, the invention proposes to make this depression slightly wider than the rest of the depressions and to deform the laterally adjoining perforations slightly in a corresponding manner.

In order to be able to grip the proposed lightweight brick securely during processing, the invention proposes to provide, in the central region, two gripping perforations which are formed, in terms of material saving, by omitting a group of perforations. The special feature of these gripping perforations is, thus, that they do not have a geometric cross-sectional shape of their own, e.g. circle or rectangle, but simply follow the perforation pattern, the thickness of the wall of the gripping perforation not being increased, or only being increased to a very small extent, in comparison with the web thickness.

The proposed lightweight brick is better than the known bricks of its type in many ways without disadvantages, particularly in terms of the load-bearing strength having to be accepted. In particular, a favorable, measured coefficient of thermal conductivity, not achieved hitherto, of approximately $\lambda$=0.11 [W/m.K] can be expected. The brick curbs the flank transmission and is thus particularly suitable for exterior walls. Apparent densities of the brick of lower than 0.4 kg/dm$^3$ are possible. As a result, the brick has an extremely low weight and only a small amount of clay material and, correspondingly, a small amount of energy, in particular in the case of firing, are needed for its production. The low weight is of advantage for processing and transportation. By means of lower transport tonnage, more energy is saved. The low wall weight, not achieved hitherto, permits the bricks to be used, for example, for partition walls on non-supported floors, where it has not been possible to use bricks up until now. In addition to the prevention of a flank transmission, it should be pointed out that, in comparison with known bricks, a novel brick of the same mass, owing to its low natural vibration, also produces considerably better sound insulation in through-passage direction when it is used for a load-bearing interior wall. The proposed bricks lend themselves better to separation in the transverse direction than do slotted bricks, and this results, in practical building operations, in lower losses due to bricks shattering.

Finally, mention should be made of a further advantage of the described brick which comes in useful if the bricks are not ground on the horizontal bearing surfaces and are laid in a conventional manner. The thin webs and the fibrous porosity inclusions result in the webs becoming warped during cutting. Burrs form at the cutting edges, which burrs partially cover over the openings, which are already small, of the perforations, and in any case reduce the inside cross-section thereof. This results in a hitherto unattainably small amount of mortar falling in, i.e. the mortar remains essentially in the horizontal joint and only a minute amount falls into the perforations.

BRIEF DESCRIPTION OF THE DRAWINGS

Exemplary embodiments of the invention are illustrated hereinbelow with reference to the drawing, in which.

DETAILED DESCRIPTION OF THE PREFERRED EMBODIMENTS

Figure 1:
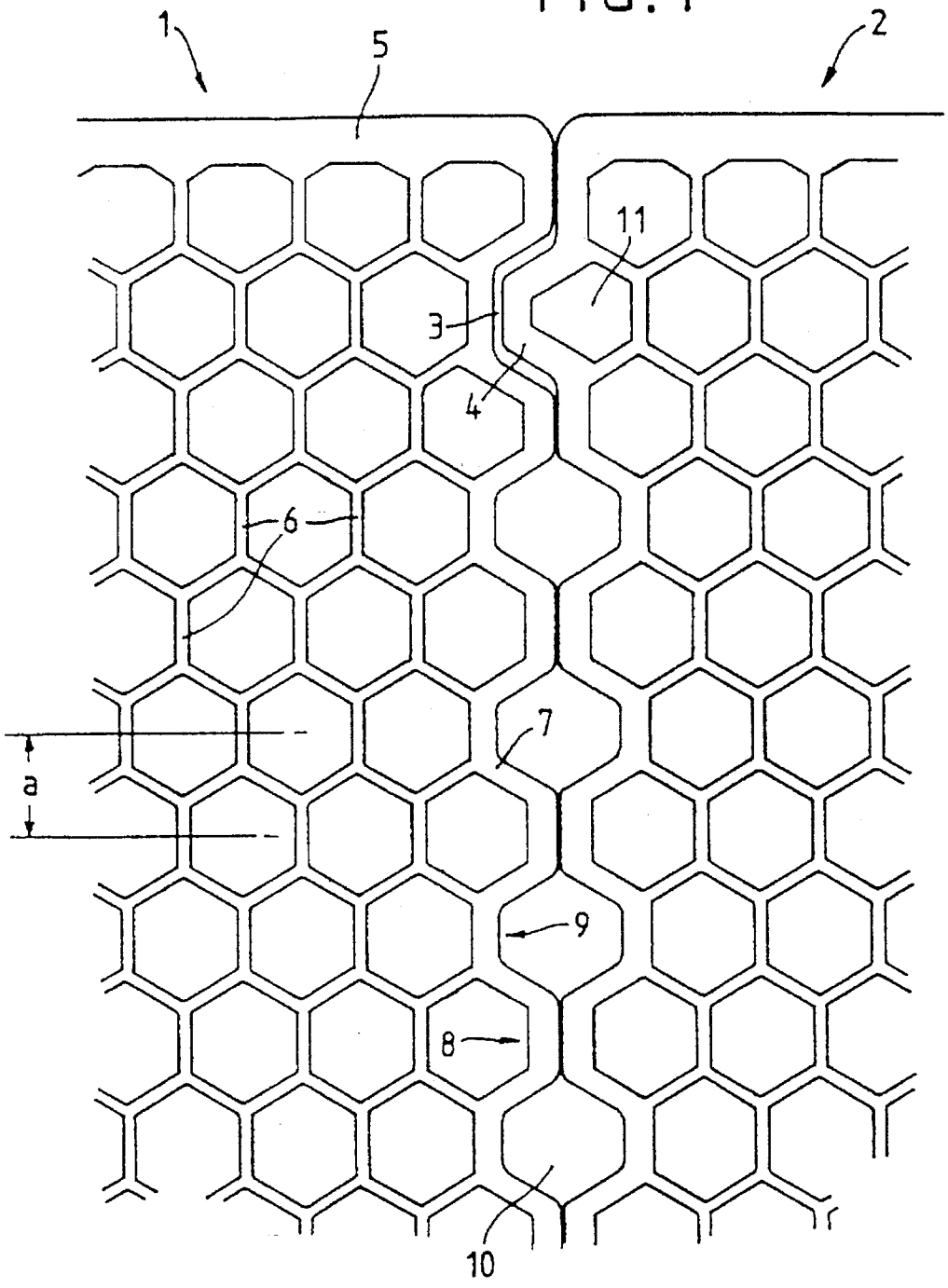
FIG. 1 shows a plan view, to scale, of two subportions of abutting lightweight bricks with honeycomb perforations.

According to FIG. 1, two bricks 1 and 2 butt against one another with their abutment sides. The figure shows a special groove 3 on the brick 1 and a tongue 4 on the brick 2. The brick 2 is an enlargement of part of the brick which is shown in its entirety in FIG. 2. There is only one tongue 4 on one abutment surface of the brick. An outer, exposed sidewall (fair-faced side) of the brick is designated 5. This also specifies the longitudinal direction of the brick.

The bricks have, moreover, a hexagonal honeycomb pattern, the hexagons being arranged such that in each case two mutually opposite corners point towards the side walls 5 and some of the webs 6 stand perpendicularly to the side walls. The thickness of the webs in this preferred exemplary embodiment is somewhat more than 2 mm. The proportion of perforations in this honeycomb pattern is 66.5%. The hexagonal perforations are slightly truncated at the side walls 5.

The walls 7 of the bricks on the abutment sides follow the outer-wall portions of those of the hexagonal perforations which form the last, transversely running perforation row of each brick. This results in the formation of protrusions 8 and depressions 9. The thickness of the wall 7 varies between approximately 3 and 5.5 mm and is thus smaller than three times the thickness of the webs. The tongue 4 projects beyond the protrusions 8. Apart from the region of this single tongue 4 and the associated groove 3, the abutment-side walls 7 of the two bricks are configured such that they are in mirror symmetry with respect to one another. The mutually corresponding protrusions 8 bear against one another. The mutually corresponding depressions 9 of the two bricks respectively form a hexagonal cavity 10 with one another. The abutment sides of the two bricks only have irregularities in the region of groove and tongue, which are arranged in the vicinity of the sidewall 5. The groove 3 is widened to a somewhat greater extent than the rest of the depressions 9. The tongue 4 contains a cavity 11 in the form of a partially trimmed hexagon.

Seen from a certain distance, the cavities 10 and 11 have much the same appearance as the rest of the hexagonal perforations, with the result that the abutment region continues the honeycomb structure overall and, as a result, has a virtually unreduced heat-insulating effect.

Figure 2:
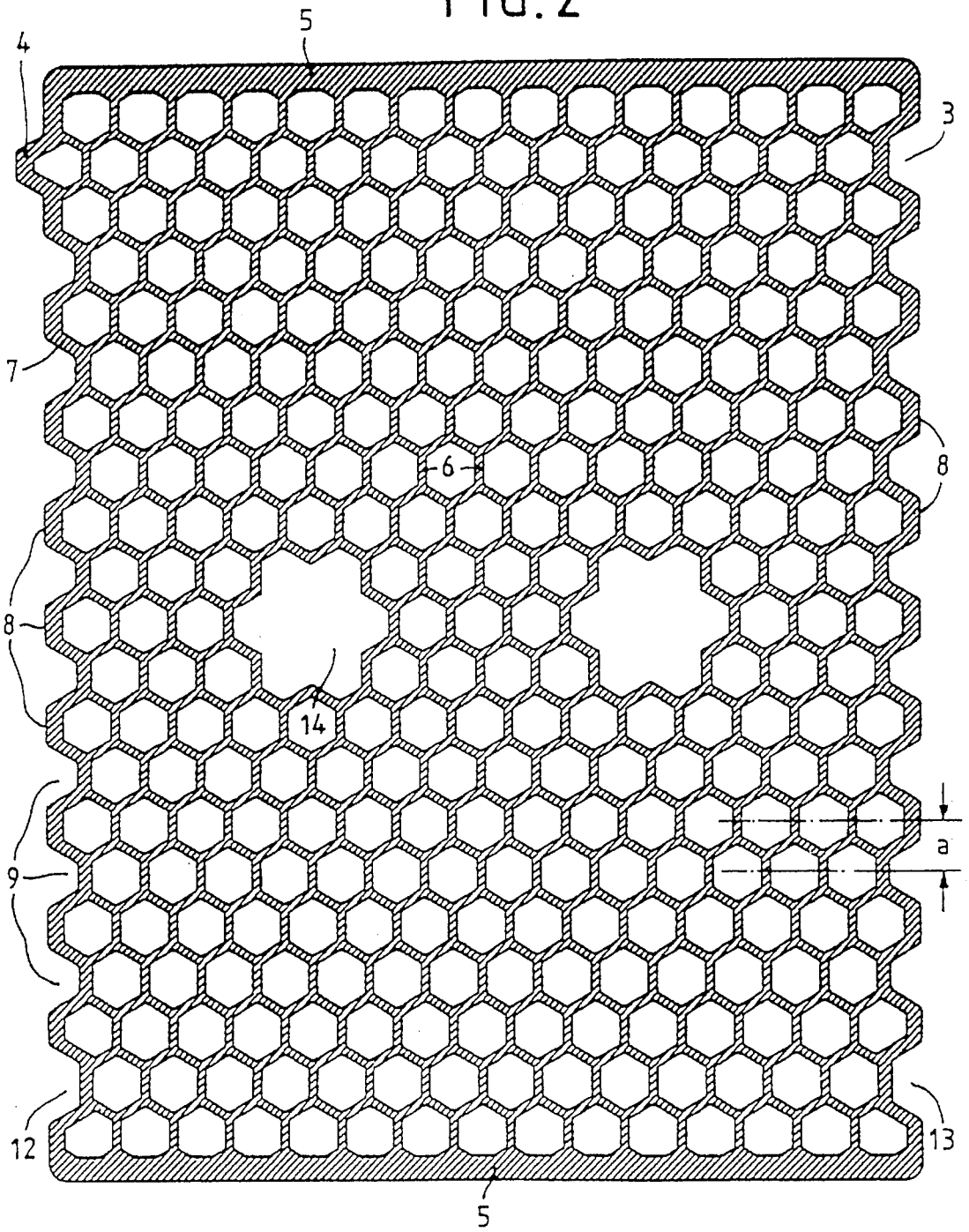
FIG. 2 shows, on a smaller scale, a horizontal section (perforation pattern) of an entire brick.

The brick, represented in its entirety in FIG. 2, has 21 perforation rows. The perforation-row spacing a is approximately 14 mm. The single, wedge-shaped tongue 4 fits into one of the three grooves 3, 12, 13, each near the sidewall 5, of an identical neighboring brick.

The advantage of this unconventional arrangement of only one tongue 4, or alternatively a plurality of tongues, on only one abutment side is that the freshly extruded green brick, which is still soft, can be set down, and conveyed, without damage on its tongue-free abutment side. It has mainly been shown that, in giving web thicknesses which are so small, the stability of the structure of the brick when it is in a position on its side does not suffice to carry its own weight because, in this case, the oblique webs form an angle of 60° with respect to the direction of the force of gravity and can thus bend. There is a danger of the green brick partially caving in in this position. In contrast, the rigidity is entirely sufficient if the green brick is placed on the abutment surface. In this position, the oblique webs form an angle of only 30° with respect to the direction of the force of gravity and thus have a higher buckling strength. The weight of the brick is distributed uniformly over the front surfaces, lying in a common transverse plane, of the protrusions 8.

Finally, mention still has to be made, with respect to this lightweight brick, of two gripping perforations 14 which are arranged, in the central region of the brick, one behind the other in the longitudinal direction. Each gripping perforation 14 is produced by omitting seven hexagonal perforations.

The brick shown is 248 mm in length and 300 mm in width (thickness of the masonry-work wall). The inside width of the honeycomb perforations (perpendicularly to the webs) is 14 mm. The thickness of the sidewalls 5 is 7 mm and the thickness of the walls 7, measured in the abutment direction, is 5.5 mm. The two abutment surfaces are formed such that they are essentially in mirror symmetry with respect to one another. Of course, this type of perforation pattern can also be used to design bricks for thicker or thinner walls in correspondence with the national dimensional standard specifications, for which purpose correspondingly more or fewer longitudinally directed perforation rows can then be provided in each case.

This brick achieves the apparent-density class for bricks of 0.5 kg/dm$^3$. With respect to corresponding known bricks which are available on the German market and belong to the apparent-density class of 0.8 kg/dm$^3$, the weight of each brick is lowered from 13.5 kg to 9 kg. Nevertheless, the same static resistance to compression is achieved. The airborne-sound absorption capacity in all spatial directions exceeds that of all perforations known up until now.

Figure 10:
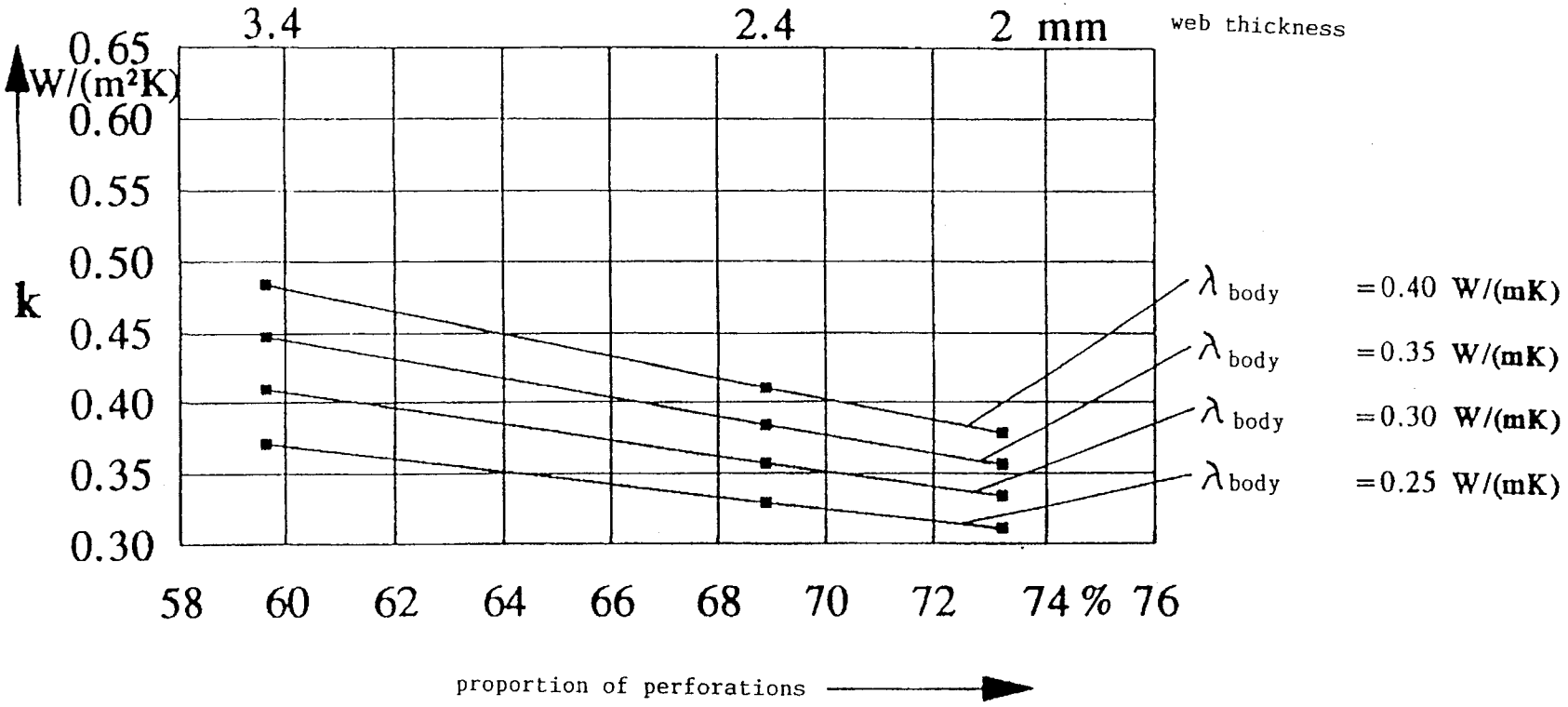
FIG. 10 shows a representation of calculated characteristic values of the brick represented in FIG. 2.

Computer calculations carried out by the Bundesanstalt für Materialprüfung (BAM) (Federal Institute for Materials Testing) in Berlin in accordance with the finite element method gave rise to the results represented in FIG. 10. Based on four different body qualities, the web thickness, and consequently the proportion of perforations, of a 300 mm wide vertically perforated brick, with honeycomb perforations, similar to FIG. 2 were varied, and the coefficient of heat transition k [W/m$^2$.K] was calculated in each case. The body materials are characterized in each case by their coefficient of thermal conductivity which lies between $\lambda_{body}$=0.40 [W/m.K] and $\lambda_{body}$=0.25 [W/m.K]. The lower value corresponds to a higher degree of porosity. It can be seen that in the case of clay which—in the interests of a high resistance to compression—has a small degree of porosity, and given a web thickness of 2 mm, a coefficient of heat transition k=0.38 (W/m$^2$.K) is achieved. This corresponds, in the case of the 30 cm thick brick according to FIG. 2, to an extremely low coefficient of thermal conductivity $\lambda$=0.12 [W/m.K].

Figure 3:
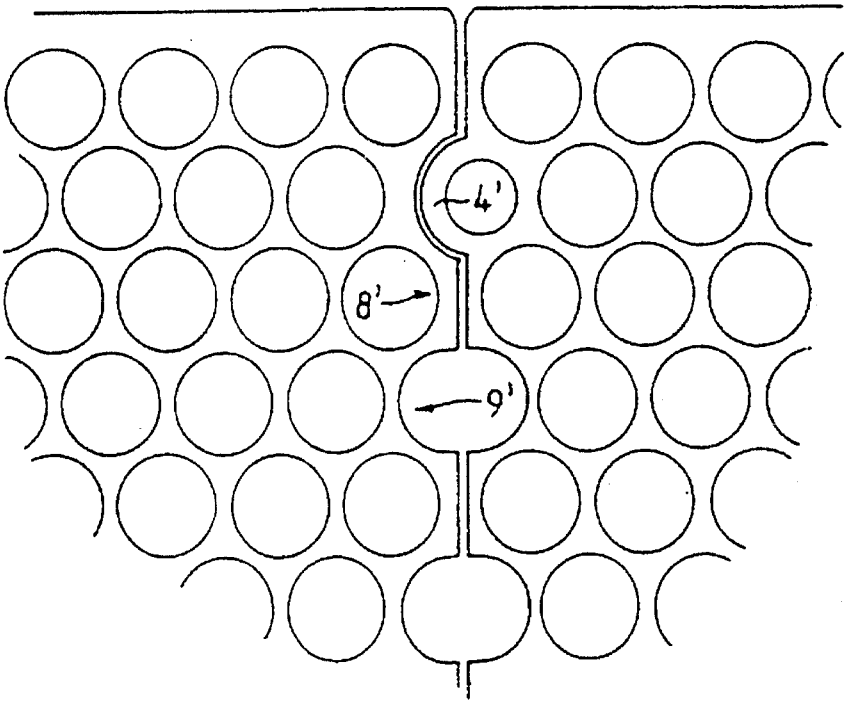
FIG. 3 shows a schematic representation, in plan view, of two sub-portions of abutting lightweight bricks with round perforations.

The abutment surfaces of the bricks with round-perforation pattern according to FIG. 3 are designed on the same principle in so far as protrusions 8' and depressions 9' are likewise formed, as can be seen from the detail, taken in a transverse plane, of the perforation pattern. The protrusions have planar portions and the depressions are configured in a circular manner. The radius of curvature of the tongue 4' corresponds approximately to the radius of the round perforations, and the radius of curvature of the corresponding groove is kept somewhat larger.

Figure 4:
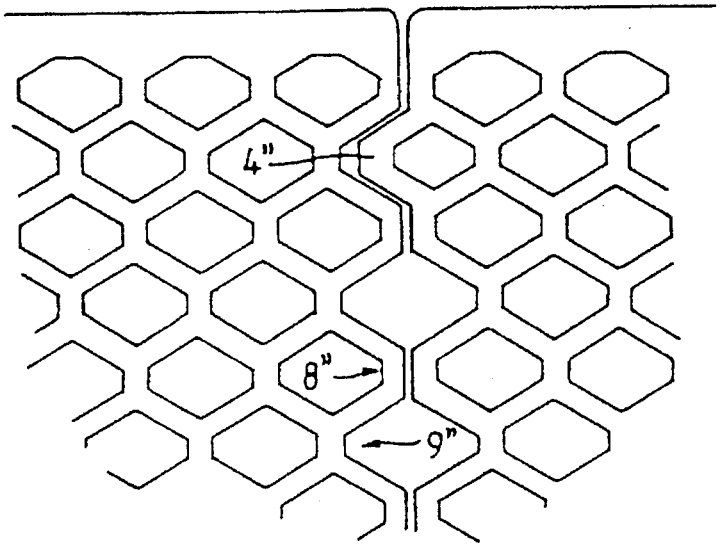
FIG. 4 shows a corresponding representation with flattened hexagonal perforations.

The shape of the perforations in the example according to FIG. 4 is a hexagon which is shortened in the transverse direction of the brick. Protrusions 8", depressions 9" and a tongue 4" can also be distinguished here, and the shape of these is similar to the perforations.

Figure 5:
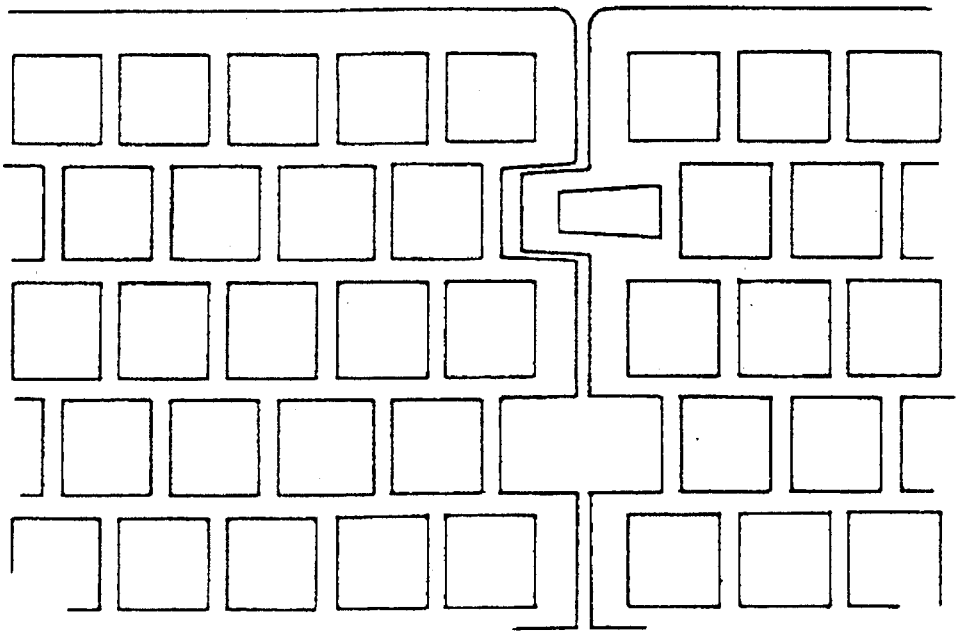
FIG. 5 shows a corresponding representation with offset square perforations.

Abutting protrusions and mutually corresponding depressions, forming a common cavity in each case, are likewise provided in the example according to FIG. 5. The tongue shown differs from the rest of the perforation pattern in as far as the tongue and its corresponding groove have wedge-shaped flanks, this resulting in a corresponding alteration of the neighboring perforations.

Figure 6:
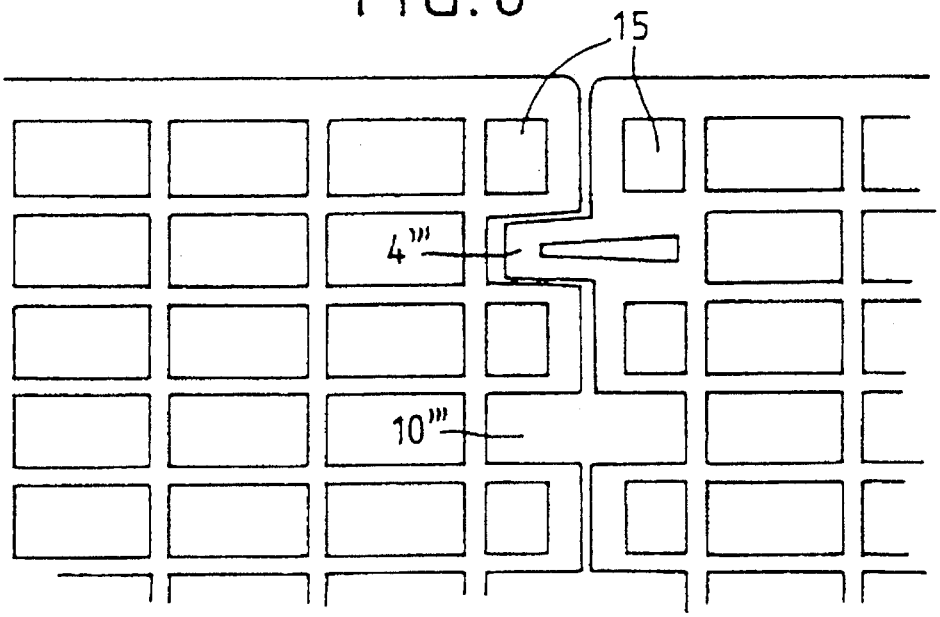
FIG. 6 shows a corresponding representation with rectangular perforations.

In contrast to all the preceding examples, the perforation rows in the perforation pattern according to FIG. 6 are not offset with respect to one another. On the contrary, the webs form a criss-cross grid. Nevertheless, mutually corresponding protrusions 8''' and depressions 9''' are formed on the abutment surfaces. The protrusions contain perforations 15 which are shortened to approximately half the length, with the result that the common cavity 10''' formed by in each case two depressions is approximately the same size as a normal rectangular perforation. Here, too, the tongue 4''' is designed with wedge-shaped flanks.

Figure 7:
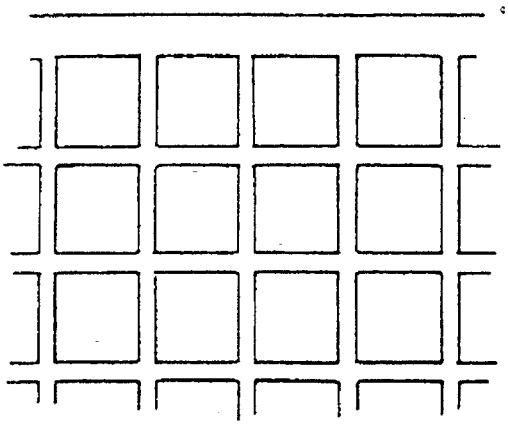
FIG. 7 shows another applicable perforation pattern with uniformly arranged square perforations.
Figure 8:
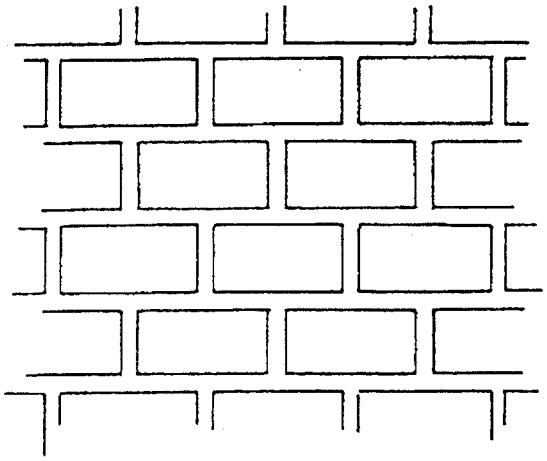
FIG. 8 shows a perforation pattern with offset rectangular perforations.
Figure 9:
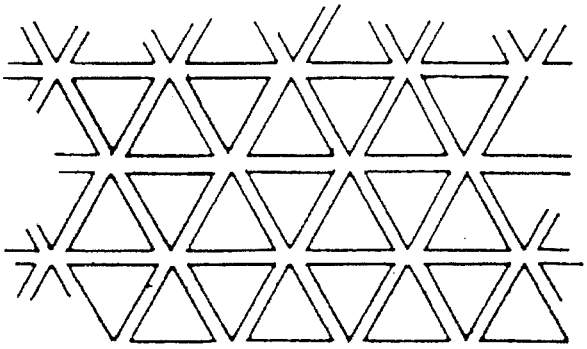
FIG. 9 shows a perforation pattern with perforations having a triangular cross-section.

FIGS. 7 to 9 show further perforation-pattern examples which may be used for bricks according to the invention.

I claim:

1. A light weight, vertically perforated brick having a pattern of perforations that exhibits a plurality of perforation rows, extending in a longitudinal direction of the brick, and webs separating the perforations from one another, wherein:

a) the webs have a thickness from 1.5 mm to not more than 4 mm;

b) each perforation has a cross section exhibiting a ratio of largest to smallest inside width that lies in a range of 1:1 to 1:1.25;

c) the perforation rows have a spacing of not more than 22 mm;

d) the perforations comprise a 50% proportion of the brick; and e) the brick is made of material having a density of less than or equal to 1.7 kg/dm$^3$.

2. The brick according to claim 1, wherein the density of the brick material is less than or equal to 1.5 kg/dm$^3$.

3. The brick according to claim 1, wherein the pattern of perforations comprises a honeycomb pattern of hexagonally shaped perforations.

4. The brick according to claim 1, wherein the brick includes a fair face that is exposed when the brick is set in a brick wall, the pattern of perforations comprises a honeycomb pattern having webs that separate the perforations and the honeycomb pattern is oriented with webs standing perpendicular to the fair face of the brick.

5. The brick according to claim 1, wherein the material of the brick includes a fibrous porosity agent.

6. The brick according to claim 5, wherein the fibrous porosity agent comprises paper fibers.

7. The brick according to claim 1, wherein the brick has an outer wall exhibiting an abutting surface for abutting another brick when set in place in a brick wall, and the outer wall has a thickness not more than 3 times the thickness of the webs.

8. A plurality of bricks each constructed according to claim 1, wherein each brick has two abutting surfaces each for abutting another brick when the bricks are set in a brick wall, wherein the abutting surfaces of abutting bricks are essentially in mirror symmetry with respect to one another, each abutting surface exhibiting protrusions and depressions following one after the other in a transverse direction of the brick along the abutting surface in accordance with the pattern of perforations so that mutually adjoining protrusions of abutting bricks come to bear against one another and mutually corresponding depressions together form respective cavities.

9. The plurality of bricks according to claim 8, wherein each brick has on one of its two abutting surfaces a tongue which projects beyond the protrusions on said one abutting surface and on the other abutting surface a groove for receiving the tongue of an abutting brick when said bricks are set in place in a brick wall.

10. The plurality of bricks according to claim 8, wherein said groove is slightly wider than the depressions on said other abutting surface, resulting in a slight deformation of the perforations adjoining the groove laterally.

11. A light weight, vertically perforated brick having a pattern of perforations that exhibits a plurality of perforation rows, extending in a longitudinal direction of the brick, and webs separating the perforations from one another, wherein:

a) the webs have a thickness from 2.0 mm to not more than 5 mm;

b) each perforation has a cross section exhibiting a ratio of largest to smallest inside width that lies in a range of 1:1 to 1:1.2;

c) the perforation rows have a spacing of not more than 20 mm;

d) the perforations comprise at least a 55% proportion of the brick; and e) the brick is made of material having a density of less than or equal to 1.55 kg/dm$^3$.

12. A light weight vertically perforated brick having a pattern of perforations that exhibits a plurality of perforation rows, extending in a longitudinal direction of the brick, and webs separating the perforations from one another, wherein:

a) the webs have a thickness from 3.4 mm to not more than 4 mm;

b) each perforation has a cross section exhibiting a ratio of largest to smallest inside width that lies in a range of 1:1 to 1:1.2;

c) the perforation rows have a spacing of not more than 18 mm;

d) the perforations comprise a 60% proportion of the brick; and e) the brick is made of material having a density of less than or equal to 1.5 kg/dm$^3$.

* * * * *